US010287529B2

(12) United States Patent
Andreoli et al.

(10) Patent No.: US 10,287,529 B2
(45) Date of Patent: May 14, 2019

(54) COMPOSITION FOR DETERGENT FOR CLEANING

(71) Applicant: INNOSPEC PERFORMANCE CHEMICALS EUROPE LIMITED, Cheshire (GB)

(72) Inventors: Alessandra Andreoli, Mantova (IT); Massimo Mor, Mantova (IT); Federico Biasibetti, Brescia (IT)

(73) Assignee: INNOSPEC PERFORMANCE CHEMICALS EUROPE LIMITED, Cheshire (GB)

( * ) Notice: Subject to any disclaimer, the term of this patent is extended or adjusted under 35 U.S.C. 154(b) by 72 days.

(21) Appl. No.: 15/501,029

(22) PCT Filed: Aug. 14, 2015

(86) PCT No.: PCT/EP2015/068745
§ 371 (c)(1),
(2) Date: Feb. 1, 2017

(87) PCT Pub. No.: WO2016/026777
PCT Pub. Date: Feb. 25, 2016

(65) Prior Publication Data

US 2017/0218301 A1 Aug. 3, 2017

(30) Foreign Application Priority Data

Aug. 20, 2014 (EP) ..... 14425107

(51) Int. Cl.
*C11D 3/48* (2006.01)
*C11D 3/50* (2006.01)
(Continued)

(52) U.S. Cl.
CPC ..... *C11D 1/146* (2013.01); *C11D 1/523* (2013.01); *C11D 1/528* (2013.01); *C11D 3/48* (2013.01);
(Continued)

(58) Field of Classification Search
CPC ..... C11D 1/146; C11D 1/523; C11D 1/528; C11D 3/48; C11D 3/50; C11D 17/003; C11D 17/0056
See application file for complete search history.

(56) References Cited

U.S. PATENT DOCUMENTS 6,235,127 B1 5/2001 Rader et al.
6,683,035 B1 * 1/2004 Koester ..... C11D 1/74 510/191
2008/0190457 A1 8/2008 Veltman

FOREIGN PATENT DOCUMENTS

EP 0268967 A2 6/1988
EP 1086199 A1 3/2001
(Continued)

OTHER PUBLICATIONS

International Search Report dated Oct. 26, 2015 for PCT/EP2015/068745.
(Continued)

*Primary Examiner* — Brian P Mruk
(74) *Attorney, Agent, or Firm* — Burns & Levinson LLP; Janine M. Susan

(57) ABSTRACT

The invention is related to a precursor for making a detergent and a detergent comprising •water; •an alkyl sulfate; •a fatty acid alkanolamide and/or a fatty acid amidoamine; wherein the fatty acid alkanolamide corresponds to the formula (I) and wherein the fatty acid amidoamine corresponds to the formula (II).
(Continued)

(I)

(II)

24 Claims, 5 Drawing Sheets

(51) Int. Cl.
*C11D 1/14* (2006.01)
*C11D 1/52* (2006.01)
*C11D 17/00* (2006.01)

(52) U.S. Cl.
CPC ..... *C11D 3/50* (2013.01); *C11D 17/003* (2013.01); *C11D 17/0056* (2013.01)

(56) References Cited

FOREIGN PATENT DOCUMENTS

| | | | |
|---|---|---|---|
| EP | 1318191 | A1 | 6/2003 |
| EP | 1325103 | A1 | 7/2003 |
| EP | 1978080 | A1 | 10/2008 |
| EP | 2316914 | A1 | 5/2011 |
| GB | 2061313 | A | 5/1981 |
| WO | 99/10470 | A1 | 3/1999 |
| WO | 9966017 | A1 | 12/1999 |
| WO | 2011/158029 | A1 | 12/2011 |

OTHER PUBLICATIONS

Extended European Search Report dated Jan. 28, 2015 for EP14425107.1.

International Preliminary Report on Patentability, International Search Report and Written Opinion for International Application No. PCT/EP2015/067845, dated Feb. 21, 2017.

* cited by examiner

COMPOSITION FOR DETERGENT FOR CLEANING

CROSS-REFERENCE TO RELATED APPLICATIONS

This application is a U.S. national stage application under 35 U.S.C. 371 of co-pending International Application No. PCT/EP2015/068745 filed on Aug. 14, 2015 and entitled COMPOSITION FOR DETERGENT FOR CLEANING, which in turn claims priority to European Patent Application No, 14425107.1 filed on Aug. 20, 2014, the contents of which are incorporated by reference herein in their entirety for all purposes.

The invention is related to a precursor for making a detergent for cleaning. In addition the invention is related to detergent comprising the precursor, a process for making the detergent and the precursor product. Furthermore, the invention is related to the use of the detergent as a sanitary product e.g. in a sanitary object.

Sanitary products that can be put directly on the surface of a sanitary object to be cleaned, such as a toilet bowl, and that adheres there without the need of a cage, are known. These sanitary products adhere directly to the surface of the sanitary object and are rinsed off completely only after a large number of flushing. Due to the direct adhesion of the sanitary product, it is not necessary to use additional containers such as the so-called "WC cages". The use of WC cages is perceived as unhygienic by the consumer especially when replacing the sanitary product and when the toilet is being cleaned.

It is an object of present invention to provide a new detergent that preferably can be used as a sanitary product that is able to adhere to a sanitary surface, where a small part is dissolved in water, when flushing occurs, and only is rinsed off after a large number of flushings.

It is a further object of present invention to provide a new detergent that preferably can be used as a sanitary product that can be transparent, and where the transparency remains in a broad and ambient temperature range.

It is a further object of present invention to provide a precursor which can form a detergent, preferably a sanitary product that is a hard ringing gel and adheres to a toilet bowl by adding other compounds, wherein the other compounds can for example comprise perfumes, lime scale removers, bleaching agents, enzymes, polymers, dyes or biocides which can vary.

These objects, amongst others are met, at least partially, by the precursor and the detergent for cleaning, as can be found in the attached claims.

SUMMARY OF THE INVENTION

In a first aspect, the invention is related to a precursor for making a detergent for cleaning wherein the precursor comprises water;

an alkyl sulfate;

a fatty acid alkanolamide and/or a fatty acid amidoamine;

wherein the precursor is in a lamellar phase, and forms a hard ringing gel after addition of extra water and one or more non-polar compounds;

wherein the fatty acid alkanolamide corresponds to the formula (I)

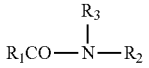

wherein R1 is an alkyl, alkenyl, hydroxyalkyl or hydroxyalkenyl having 6 to 22 carbon atoms, R2 is a hydroxyalkylgroup containing 2 to 6 carbon atoms, and R3 is hydrogen or an alkyl group or has the same meaning as R2;

and wherein the fatty acid amidoamine corresponds to the formula (II)

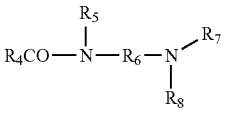

wherein R4 is alkyl, alkenyl, hydroxyalkyl or hydroxyalkenyl containing 6 to 22 carbon atoms;

R5 is hydrogen, an alkyl group, or a hydroxyalkylgroup containing 2 to 4 carbon atoms; R6 is an alkyl group containing 2 to 4 carbon atoms; and R7 and R8 are each independently hydrogen, an alkyl group, or a hydroxyalkyl group containing 2 to 4 carbon atoms. Preferably, the ringing gel formed by the precursor is a sanitary product that is able to adhere to a sanitary object.

In a second aspect the invention is related to a detergent for cleaning and/or disinfecting and/or deodorizing, comprising the precursor according to the first aspect of the invention, one or more non-polar compounds and/or a perfume, wherein the detergent is a ringing gel with a hard gel point higher than 40° C., more preferably higher than 50° C.

Preferably, the detergent is a sanitary object, that is able to adhere to the sanitary object after application.

In a third aspect the invention is related to a method for producing a detergent comprising the steps of heating water to a temperature of 70-80° C.;

adding a precursor according to the first aspect of the invention;

optionally adding a perfume, gel point modifier, a solubility modifier, a pH modifier, a structuring agent, a preservative, a complexing agent, a biocide, a polymer, a lime scale remover, a bleaching agent, enzymes and/or a dye;

adding one or more non-polar compounds cooling the obtained mixture to room temperature to obtain a hard ringing gel detergent for cleaning.

In a fourth aspect, the invention is also related to the method of making the precursor according to the first aspect of the invention.

DEFINITIONS

"Lamellar" phases are phases which comprise a plurality of bilayers of surfactant arranged in parallel and separated by liquid medium. They include both solid phases and the typical form of the liquid crystal G-phase. G-phases are typically pourable, non Newtonian, anisotropic products. They are typically viscous-looking, opalescent materials with a characteristic "smeary" appearance on flowing. They form characteristic texture under the polarising microscope and freeze fractured samples have a lamellar appearance under the electron microscope. X-ray diffraction or neutron scattering similarly reveal a lamellar structure, with a principal peak typically between 4 and 10 nm, usually 5 to 6 nm. Higher order peaks, when present occur at double or higher integral multiples of the Q value of the principal peak. Q is the momentum transfer vector and is related, in the case of lamellar phases, to the repeat spacing d by the equation $Q=2n[\pi]/d$ where n is the order of the peak.

G-phases, however, can exist in several different forms, including domains of parallel sheets which constitute the bulk of the typical G-phases described above and spherulites formed from a number of concentric spheroidal shells, each of which is a bilayer of surfactant. In this specification the term "lamellar" will be reserved for compositions which are at least partly of the former type. Opaque compositions at least predominantly of the latter type in which the continuous phase is a substantially isotropic solution containing dispersed spherulites are referred to herein as "G-phase compositions". G phases are sometimes referred to in the literature as $L_{(alpha)}$ phases.

The "gel point" (also called the sol-gel transition temperature or "gel temperature" or $T_{SG}$) is determined via rheological measures (Oscillation mode) and it is detected when G'=G" or tan δ=G"/G'=1 or δ is 45° C. Basically, $T_{SG}$ corresponds to the intersection of the curves G' and G", where G' is the "storage modulus" (Pa) and G" is the "loss modulus" (Pa).

The G' value is a measure of the deformation energy stored by the sample during a shear process. After a load is removed, this energy is completely available, now acting as the driving force for the reformation process which will compensate partially or completely the previously obtained deformation of the structure. Materials which are storing the whole deformation energy applied are showing completely reversible deformation behavior since after a load cycle, finally the materials obtain an unchanged shape. G' represents the elastic behavior of a material.

The G" value is a measure of the deformation energy used up by the sample during a shear process and therefore afterwards, it is lost for the sample. This energy is spent during the process of changing the material's structure, i.e. when the sample is flowing partially or altogether. Flow, and also viscoelastic flow, means: there is a relative motion between the molecules, clusters, particles, aggregates or other components of the superstructures such as "domains" or crystals. A detailed description can be found in Thomas G. Mezger—The Rheology Handbook, 3rd revised edition, 2011.

FIG. 1 shows an example of a way of measuring a gel point of a detergent according to the invention using HAAKE Rheo Stress 1 rheometer with Peltier thermostat wherein first a Strain Sweep is determined at fixed frequency (1 Hz) by selecting a proper strain or deformation (load) that falls in the LVE (Linear Viscoelastic) range, then a frequency sweep at a fixed strain is selected to define a proper frequency in the linear viscoelastic range, and further a Temperature Sweep at fixed frequency and strain is selected to find G' and G" and the cross over (sol-gel transition temperature). In this case the gel point was determined at a frequency of 1 Hz, and a temperature ramp of 10-80° C. using a strain of 0.5% using a cone/plate system having an incline of 1° with a diameter of 35 mm.

The term "Pourable" is used herein to mean that approximately 100 mL of product in a 200 mL jar, when inverted at room temperature, will flow substantially to the bottom of the jar in less than 30 minutes.

The term "non pourable" is used herein to mean approximately that when 100 mL of product in a 200 mL jar is inverted at room temperature, none or a small part of the product will have flowed to the bottom of the jar after 30 minutes.

"Thaw point" or "set point" (° C.) are used herein to describe a physical property of a composition in a lamellar phase. They are determined via rheological measures (rotational mode, shear rate versus temperature), whereby an appropriate level of shear stress (40 Pa) is applied to a frozen sample (−5° C. or −10° C. wherein the composition is set) and the temperature is slowly increased. From the moment the sample thaws, the shear rate increases, indicating that the sample starts to flow. The temperature at which the shear rate increases is the "thaw point" or "set point".

By way of example, FIG. 2 shows the thaw point of a precursor using HAAKE Rheo Stress 1 rheometer with Peltier thermostat, using rotational mode at shear stress of 40 Pa and a temperature range is set at −5 to +30° C., using a Cone/Plate of C35/1°.

The term "Ringing gel" is used herein to mean a characteristic property which is observed when a jar or beaker containing a tridimensional structure is sharply struck, a distinctive vibration can be felt in the composition. Tridimensional structures as cubic phases and hexagonal phases can form "ringing gels". A "hard" ringing gel is a ringing gel which is not pourable and has a gel point higher than room temperature. The hard ringing gel is a viscoelastic system where, at room temperature, G' is higher than G", where G' is higher than 100,000 Pa and δ(phase shift angle or loss angle), is below 45°, preferably below 10°.

The viscous isotropic "cubic phases" or "VI" phases are typically immobile, non-Newtonian, optically isotropic and are typically transparent, at least when pure. VI phases have a cubic symmetrical diffraction pattern, under X-ray diffraction or neutron scattering, with a principal peak and higher order peaks at $2^{0.5}$ and $3^{0.5}$ times the Q-value of the principal peak.

These cubic liquid crystalline phases are sometimes observed immediately following the micellar phase at ambient temperature as the concentration of surfactant is increased. It has been proposed that such VI phases, sometimes referred to as $I_1$ phase, may arise from the packing of micelles (probably spherical) in a cubic lattice. At ambient temperature a further increase in surfactant concentration usually results in hexagonal phase ($H_1$), which may be followed by a lamellar phase (G). $I_1$ phases, when they occur, are usually only observed over a narrow range of concentrations, typically just above those at which the $L_1$-phase is formed. The location of such VI phases in a phase diagram suggests that the phase is built up of small closed surfactant aggregates in a water continuum.

"Hexagonal phases" or "M-phases" are typically immobile, anisotropic products resembling low melting point waxes. They give characteristic textures under the polarising microscope, and a hexagonal diffraction pattern by X-ray or neutron diffraction which comprises a major peak, usually at values corresponding to a repeat spacing between 4 and 10 nm, and sometimes higher order peaks, the first at a Q-value which is $3^{0.5}$ times the Q-value of the principal peak and the next double the Q-value of the principal peak. M-phases are sometimes referred to in the literature as H-phases (Hexagonal).

The different phases described above can be recognized by a combination of appearance, rheology, textures under the microscope, electron microscope or X-ray diffraction or neutron scattering. A detailed description with illustrations of the different textures observable using a polarizing microscope, can be found in Rosevear, JAOCS Vol. 31 P628 (1954) or in J. Colloid and Interfacial Science, Vol. 20 No. 4, P. 500 (1969).

The term "surfactant" refers to any agent that lowers the surface tension of a liquid.

The term "detergent" refers to any substance or composition containing soaps and/or other surfactants intended for washing and cleaning processes but also surfactant systems for a controlled release of volatile components into the air. According to this invention the detergent is preferably a sanitary product, but can also be used for other applications such as fabric care and surface care for household, institutional or industrial purposes, personal care and also air fresheners and insect repellents.

DETAILED DESCRIPTION

As described, the invention is related to a precursor for making a detergent for cleaning, preferably a sanitary product, which can also be used for disinfecting and/or deodorizing. In case the detergent is a sanitary product, it is able to adhere to a sanitary object. The precursor comprises water;

an alkyl sulfate;

a fatty acid alkanolamide and/or a fatty acid amidoamine;

wherein the precursor is in a lamellar phase, and forms a ringing gel after addition of an extra amount of water and one or more non-polar compounds;

The fatty acid alkanolamide corresponds to the formula

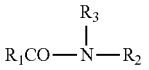

(I)

wherein R1 is an alkyl, alkenyl, hydroxyalkyl or hydroxyalkenyl containing 6 to 22 carbon atoms, R2 is a hydroxyalkylgroup containing 2 to 6 carbon atoms, and R3 is hydrogen, an alkyl group, preferably containing 1-4 carbon atoms or has the same meaning as R2. "Hydroxyalkyl" or "hydroxyalkenyl" or "hydroxyalkylgroup" refers to moieties that can have one or more OH groups.

The fatty acid amidoamine corresponds to the formula

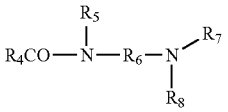

(II)

wherein R4 is an alkyl, alkenyl, hydroxyalkyl or hydroxyalkenyl containing 6 to 22 carbon atoms;

R5 is hydrogen, an alkyl group, preferably containing 1 to 4 carbon atoms, or a hydroxyalkyl group containing 2 to 4 carbon atoms; R6 is an alkyl group containing 2 to 4 carbon atoms or a hydroxyalkyl group containing 2 to 4 carbon atoms; and R7 and R8 are each independently hydrogen or an alkyl group, independently preferably containing 1 to 4 carbon atoms or a hydroxyalkyl group containing 2 to 4 atoms. "Hydroxyalkyl" or "hydroxyalkenyl" or "hydroxyalkyl group" refers to moieties that can have one or more OH groups.

The inventors surprisingly found that a fatty acid alkanolamide and/or a fatty acid amidoamine together with water and an alkyl sulfate can form a precursor which is in a lamellar phase which can form a hard ringing gel after addition of an extra amount of water and a non-polar compound. Several types of non-polar compounds can be used to be added to the precursor. The producer of detergents can use the same precursor as basis for making different types of sanitary products e.g. each having slightly different properties such as a different color or smell, or can e.g. use this as a basis for fabric care, surface care, personal care products and also air fresheners and insect repellents wherein e.g. depending on the end use of the detergent other compounds can be added. In addition, the precursor is pourable at a temperature that is 5 to 10 degrees higher than its set point and more. The set point of the precursor is preferably below 25° C., preferably between 5 and 25° C. Preferably, the precursor is pourable at a temperature which is between 15 and 30° C., more preferably around 25° C., which makes it easier to handle for making a hard ringing gel. One important ingredient in the precursor, the fatty acid alkanolamides and amidoamines such as Cocamide MIPA, Cocamide MEA, Stearamidopropyl dimethylamine, Cocamidopropyl dimethylamine are normally solid at room temperature. However when they are mixed with an alkyl sulfate and water to form a precursor that is in a lamellar phase, they are pourable and thus processable at room temperature. After the one or more non-polar compounds and extra water is added, the detergent is formed which is a ringing gel that is hard at ambient temperature. The inventors found that the detergent can adhere to a vertical surface. This is in particular useful when the detergent is a sanitary product which can adhere to a sanitary object without becoming detached through a plurality of streams of rinse water. Each time the toilet is flushed a portion of the sanitary product is washed away and released in the toilet to provide a cleaning and/or disinfecting and/or perfume or other treatment action.

The fatty acid alkanolamide corresponds to the formula

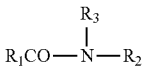

(I)

wherein R1 is an alkyl, alkenyl hydroxyalkyl and hydroxyalkenyl containing 6 to 22 carbon atoms, R2 is a hydroxyalkyl group containing 2, 3, 4, 5 or 6 carbon atoms, and R3 is hydrogen or an alkyl group or has the same meaning as R2. Preferably, R2 is a hydroxyisopropyl group, in which case the molecule can be referred to as an alkanoyl isopropanol amide. Preferably R3 is hydrogen.

Suitable examples of the fatty acid alkanolamides are Cocamide MIPA (i.e. EMPILAN® CIS), Cocamide MEA (i.e. EMPILAN® CME/T), Cocamide DEA (i.e. EMPILAN® 2502), Cocamide methyl MEA, Lauramide MEA, Lauramide DEA, Lauramide MIPA, Myristamide MEA, Myristamide DEA, Myristamide MIPA, Stearamide MEA, Stearamide DEA, Stearamide MIPA, Hydroxystearamide MEA, Isostearamide DEA, N-Tris(hydroxymethyl) methyl lauramide, Oleamide MEA, Oleamide DEA; Oleamide MIPA, Soyamide MEA, Soyamide DEA, Soyamide MIPA, Behenamide MEA, Behenamide DEA, Palmitamide MEA, Palmitamide DEA, Ricinoleamide MEA, Ricinoleamide DEA, Ricinoleamide MIPA, Tallowamide MEA, Tallowamide DEA, Undecylenamide MEA, Undecylenamide DEA, N-Lauroyl-N-methylglucamide, N-Cocoyl-N-methylglucamide or a mixture thereof.

The most preferred fatty acid alkanolamide is Cocamide MIPA (i.e. EMPILAN® CIS).

The fatty acid amidoamine corresponds to the formula

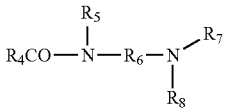

(II)

wherein R4 is alkyl, alkenyl, hydroxyalkyl, or hydroxyalkenyl containing 6 to 22 carbon atoms; R5 is hydrogen or an alkyl group or a hydroxyalkylgroup containing 2, 3, or 4 carbon atoms; R6 is an alkyl group containing 2, 3, or 4 carbon atoms; and R7 and R8 are each independently hydrogen, an alkyl group or a hydroxyalkylgroup containing 2, 3 or 4 carbon atoms.

Suitable examples of the fatty acid amidoamines are Stearamidopropyl Dimethylamine (e.g. EMPIGEN® S 18), Cocamidopropyl dimethylamine (e.g. EMPIGEN® AS/F90), Lauryl Myristyl amidopropyl dimethylamine (e.g. EMPIGEN® AS/L90), Stearamidoethyl diethylamine, Isostearamidopropyl dimethylamine, Lauramidopropyl dimethylamine, Myristamidopropyl dimethylamine, Soyamidopropyl dimethylamine, Oleamidopropyl dimethylamine, Palmitamidopropyl dimethylamine, Ricinoleamidopropyl dimethylamine, Tallowamidopropyl dimethylamine, Behenamidopropyl dimethylamine or a mixture thereof.

Preferably, the fatty acid alkanolamide and/or the fatty acid amidoamine have a content of between 25 wt % and 45 wt %, more preferably between 30 and 40; and even more preferably between 34 and 36 wt % based on the total weight of the precursor.

The precursor further comprises an alkyl sulfate. Preferably, the alkyl group in the alkyl sulfate contains 6-22 carbon atoms. In one embodiment the alkyl sulfate is metallic alkyl sulfate. In another embodiment the alkyl sulfate is an amine derivative of an alkyl sulfate such as ammonium alkyl sulfate, alkyl amine alkyl sulfate, alkanolamine alkyl sulfate or a mixture thereof. Suitable examples alkyl sulfates are sodium lauryl sulfate (e.g. EMPICOL®LX, LZ series), Ammonium lauryl sulfate (e.g. EMPICOL®AL series), MEA-lauryl sulfate (e.g. EMPICOL®LQ series), DEA-lauryl sulfate, Diisopropanolamine lauryl sulfate, TEA-lauryl sulfate (e.g. EMPICOL® TL series), Magnesium Lauryl sulfate, MIPA-lauryl sulfate, TIPA-Lauryl sulfate, Potassium lauryl sulfate, Ammonium myristyl sulfate, MEA-myristyl sulfate, DEA-myristyl sulfate, TEA-myristyl sulfate, sodium myristyl sulfate, Ammonium cetyl sulfate, DEA-cetyl sulfate, sodium cetyl sulfate, Sodium cetearyl sulfate, Sodium cetostearyl sulfate, Ammonium coco-sulfate, Sodium tallow sulfate, Sodium Oleyl sulfate, DEA oleyl sulfate, sodium 2-ethylhexylsulfate (e.g. EMPICOL® 0585 series), Sodium Decyl sulfate (e.g. EMPICOL® 0758 series), Sodium C10-C12 fatty alcohol sulphate (e.g. EMPICOL® 0335 series), Sodium C8-C10 fatty alcohol sulphate, or a mixture thereof. In one embodiment, the alkyl sulfate has a content of between 25 wt % and 45 wt %, more preferably between 30 and 40 wt % and even more preferably between 34 and 36 wt % based on the total weight of the precursor. It has been found that the alkyl sulfate and the fatty acid alkanolamide and/or fatty acid amidoamine contribute to the deterging effect of the detergent, when the product is used. In one embodiment the relative ratio of the amount of alkyl sulfate and the fatty acid amidoamine and/or the fatty acid alkanolamide is between 40/60 and 60/40, more preferably between 45/55 and 50/50. Other ratios provide ringing gels that are not so clear and are hazy or cloudy ringing gels that are not homogenous.

Optionally, the precursor further comprises a hydrotrope. As used herein "a hydrotrope" is a compound that comprises a hydrophilic part and a hydrophobic part where the hydrophobic part is too small to cause spontaneous self-aggregation. Suitable hydrotrope compounds are short chain sulfonates as toluene sulfonic acid, Na salt (e.g. ELTESOL® ST series); toluene sulfonic acid, K salt; xylene sulfonic acid, Na salt (e.g. ELTESOL® SX series); xylene sulfonic acid, ammonium salt (e.g. ELTESOL®AX series); xylene sulfonic acid, K salt (e.g. ELTESOL® PX series); xylene sulfonic acid, Ca salt; cumene sulfonic acid, Na salt (e.g. ELTESOL® SC series); or cumene sulfonic acid, ammonium salt (e.g. ELTESOL®CA series); or a combination thereof. An especially preferred hydrotrope is a cumene sulfonic acid Na salt (ELTESOL® SC series), also called sodium cumene sulphonate (SCS). Also other organic compounds as urea, thiourea, ethanol, isopropanol, glycerol, ethylene and or propylene glycol ethers, can be suitable hydrotropes. The inventors found that a hydrotrope such as e.g. SCS helps to provide a gel that is clear after the addition of the one or more non-polar compounds. The hydrotrope contributes to the solubilisation of the hydrophobic compounds that can give haziness in the detergent.

Preferably, the hydrotrope is added with a concentration of between 0 wt % and 10 wt %, more preferably between 4 and 8 wt %; and even more preferably between 5 and 7 wt % based on the total weight of the precursor.

The precursor also comprises water. Preferably, the water is added with a concentration of between 16 wt % and 44 wt %, preferably between 20 and 40 wt % based on the total weight of the precursor.

As described, the precursor comprises at least three compounds, being water, alkyl sulfate, a fatty acid alkanolamide and/or a fatty acid amidoamine and forms a lamellar phase. The concentration of the three compounds may have an influence on the formation of the lamellar phase.

In one embodiment the set point of the precursor is preferably below 25° C., preferably between 5 and 25° C., more preferably between 5 and 20° C. This makes that the precursor is pourable at a temperature of at least 5 a 10° C. higher than the set point, which enables that the precursor is pourable at ambient temperatures.

The second aspect of the invention is related to a detergent for cleaning and/or disinfecting and/or deodorizing. When the detergent is a sanitary product, it is able to adhere to the sanitary object after application comprising the precursor described in the first aspect of the invention, one or more non-polar compounds and/or a perfume, wherein the detergent is a ringing gel.

The inventors found that when the detergent is used as a sanitary product, it can be applied directly on a hard surface, such as a ceramic surface of a toilet bowl, shower, sink, tile and the like. Each time water flows over the composition, a portion of the composition is released into the water that flows over the composition. This dissolution may be homogeneous and the product does not drip of the hard surface. The portion of the composition released onto the water covered surface can provide a continuous wet film to the surface to in turn provide for immediate cleaning and/or disinfecting and/or fragrancing or other surface treatment depending on the active agent(s) present in the composition.

The perfume is released on a controlled way. The adhesion of the detergent allows application on a vertical surface without becoming detached through a plurality of streams of rinse water. Once the product is completely washed away, nothing remains for removal. The detergent can also be used for fabric care, e.g. laundry detergent or fabric pretreating The detergent gel can e.g. be a unit dose that provides enough cleaning capacity for one washing cycle. The detergent comprises thus water, an alkyl sulfate as described above and a fatty acid alkanolamide and/or a fatty acid amidoamine as described above in the first aspect of the invention.

Preferably, the fatty acid alkanolamide and/or the fatty acid amidoamine have a content of between 8 wt % and 20 wt %, more preferably between 12 and 16 wt %; and even more preferably between 13 and 15 wt % based on the weight of the detergent.

Preferably, the alkyl sulfate has a content of between 5 wt % and 20 wt %, more preferably between 12 and 16 wt %; and even more preferably between 13 and 15 wt % in the detergent.

To be able to form a detergent that is a hard ringing gel, the inventors found that it is required to add an extra amount of water and one or more non-polar compounds to the precursor. The "one or more non-polar compounds" are any water insoluble (immiscible) organic liquid due to their high IFT (Interfacial Tension). The "non-polar compounds" are apolar, low and medium polarity organic liquids that are immiscible with water. Preferably, the IFT of the non-polar compounds are higher than 15 mN/m. The one or more non-polar compounds induce a phase change in the composition. E.g. a non-polar compound can induce the transition of a lamellar phase to a cubic phase, passing through a hexagonal phase.

In one embodiment, the concentration of the one or more non-polar compounds is between 3 wt % and 30 wt %, more preferably between 7 and 25 wt % and even more preferably between 9 and 20 wt %. The formation of the ringing gel may be influenced by the concentration of the compounds that form the precursor and the concentration of the one or more non-polar compounds.

Typically, extra water is added to form detergent ringing gel. The concentration of the total amount of water in the detergent may vary between 35 and 70 wt %, preferably between 40 and 65 wt %, more preferably between 42 and 62 wt % based on the total weight of the detergent. Also the concentration of the water may influence the formation of a ringing gel.

The addition of the one or more non-polar compounds to the precursor induces a phase change so that a hard ringing gel is formed. The ringing gel can take the form of a cubic phase or hexagonal phase. Preferably the ringing gel is in a cubic phase. The ringing gel that is formed has a gel point that is higher than 40° C., preferably higher than 50° C.

In one embodiment, the non polar-compounds are selected from the group consisting of hydrocarbon oils, alkylcarbonates, synthetic and vegetable oils, essential oils, oily esters, silicon oils or perfumes or combination thereof. Also alkoxylated forms of these compounds can function as non-polar compounds.

Suitable hydrocarbon oils examples are white mineral oil/liquid paraffins (Lubetech White ISO 15 (1015), Lubepharm White FDA 15, Lubepharm White FDA 68, AGIP OBI 12, Blanco FDA 20, Blanco FDA 22), petrolatum (Waxe White EP-USP 06), hydrogenated polyolefin (PureSyn 2, PureSyn 4), Isoparaffinic Hydrocarbon (Isopar G, Isopar H, Isopar L, Isopar M, Isopar N, Isopar V, Isoeicosane, Isohexadecane, Isododecane, Purolan IEC, Purolan IHD, Purolan IDD). The most preferred hydrocarbon oils is white mineral oil. Suitable alkylcarbonates examples are bis(2-ethylhexyl) carbonate, didodecyl carbonate, dioctyl carbonate.

Suitable synthetic and vegetable oils are capryl/capric triglycerides, d-limonene, jojoba oil, peanut oil, sunflower oil, corn oil, coconut oil, palm oil.

Suitable essential oil are pine oil, lemon oil.

Suitable oily esters are isopropyl myristate, isopropyl stearate, isopropyl laurate, isopropyl palmitate, 2-ethyl hexyl palmitate.

Suitable silicon oils are Cetyldimethicone (Sil-o-san 8631 C), Cyclopentasiloxan (Struksilon 8601 C).

Preferably, the perfumes have a total aldehydes content of less than 5%. Perfumes with higher aldehyde content may interact with amines and amines derivatives which can induce discolouration.

The detergent may further comprise a pH modifier, pH buffers, a structuring agent, a solubility controller, a preservative, a complexing agent, a biocide, a lime scale remover, bleaching agents, enzymes, and/or a dye, perfumes and polymers or a combination thereof. Suitable examples of structuring agents are to be intended as "viscosity modifying agents" or "rheology modifiers" or "thickeners". Suitable examples are polysaccharide polymers, polycarboxylate polymers, polyacrylamides, clays and mixtures thereof. Preservatives are primarily included to reduce the growth of undesired microorganisms within the detergent during storage prior to use. Preferably the preservative is stable at a temperature of 60-80° C., since this is the temperature that might be used for making the detergent.

If the precursor does not comprise a hydrotrope, this may be added to the detergent. As described, the hydrotrope such as e.g. SCS, provides a clear gel which avoids haziness in the detergent. In addition, this compound helps the solubility of other compounds in the detergent.

Preferably, the hydrotrope is added with a concentration of between 0 wt % and 30 wt %, more preferably between 0 and 20 wt %; and even more preferably between 0 and 10 wt % based on the total weight of the detergent.

The detergent can also comprise solubility controllers to be intended as polymers with hydrating/moisturizing" properties. These are compounds that help to increase the lifespan of the detergent and have hydrating or moisturizing properties. These compounds help that only a small portion of the detergent is released after flushing the toilet at the time the product is used. In fact solubility controllers help to decrease the solubility of the product. They are substances and/or polymers with a large number of polar groups that form chemical bonds with water and surfactants in the detergent. Suitable solubility controllers are oxyalkylenated compounds, polyhydroxy organic compounds with at least two hydroxyl groups (i.e. glycols and glycol ethers), polyhydroxystearic acid (in particular 12-hydroxystearic acid homopolymer) or a mixture thereof.

Optionally the detergent comprises a polymer that can reduce the formation of lime scale as well as the propensity to resoiling.

Preferably, the detergent comprises a perfume. Perfumes are scent releasing agents. They can also provide structure to the gel, can be the one or more non-polar compounds, or can contribute as a gel point modifier. Preferably, the concentration of the perfume in the detergent is between 2 and 10 wt %, more preferably between 3 and 6 wt % in the detergent.

It is to be understood that the embodiments and the preferred features as well as the advantages for the embodiments and the preferred features as described above for the first aspect of the invention apply mutatis mutandis for this aspect of the invention.

In a third aspect the invention is related to a method for producing the detergent as described above. This can be done by:

heating water to a temperature of 70-80° C.;

optionally adding a hydrotrope adding a precursor as described in the first aspect of the invention to obtain a viscous liquid mixture;

optionally adding a perfume;

optionally adding a gel point modifier, a solubility modifier, a pH modifier, a structuring agent, a preservative, a complexing agent, a biocide, a lime scale remover, a bleaching agent, enzymes, and/or a dye;

adding one or more non-polar compounds;

cooling the obtained mixture to ambient temperature to obtain a detergent that is a hard ringing gel preferably in a cubic phase.

The detergent according to the second aspect of the invention can also be made by heating water to a temperature of 70-80° C.;

adding an anionic surfactant as described in the first aspect of the invention and let dissolve the anionic surfactant optionally add the hydrotrope to the dissolved mixture add the fatty acid alkanolamide and/or the fatty acid amidoamine as described in the first aspect of the invention to obtain a viscous liquid mixture;

optionally adding a perfume;

optionally adding a gel point modifier, a solubility modifier, a pH modifier, a structuring agent, a preservative, a complexing agent, a biocide, a lime scale remover, a bleaching agent, enzymes, and/or a dye;

adding one or more non-polar compounds;

cooling the obtained mixture to ambient temperature to obtain a detergent that is a hard ringing gel preferably in a cubic phase.

The inventors surprisingly found that when the one or more non-polar compounds are added to the viscous liquid mixture comprising the fatty acid alkanolamide and/or the fatty acid amidoamine, an anionic surfactant and water, the ringing gel can be formed. If the one or more non-polar compounds would be added before, a non processable high viscous product which is in the hexagonal or M-phase, would be formed.

Also the dissolution time of the one or more non-polar compounds in the gel preparation may vary. It is to be understood that the embodiments and the preferred features as well as the advantages for the embodiments and the preferred features as described above for the first and second aspect of the invention apply mutatis mutandis for this aspect of the invention.

In a fourth aspect, the invention is related to a method of making a precursor in a lamellar phase comprising the steps of:

heating water to a temperature of 70-80° C.;

optionally adding a hydrotrope to the water;

adding a fatty acid alkanolamide and/or a fatty acid amidoamine as described in the first aspect of the invention;

adding an anionic surfactant to obtain a precursor mixture;

homogenizing and cooling down the precursor mixture to room temperature. In case the fatty acid alkanolamide and/or the amidoamine are solid, it can be added to the water as such or it can be first melted before adding to the water.

EMPICOL, EMPIGEN, EMPILAN and ELTESOL are registered trademarks of Huntsman Corporation or an affiliate thereof in one or more, but not all countries.

The invention is further being explained by the following figures and examples that are non-limiting for the purpose of the invention.

Figure 4:
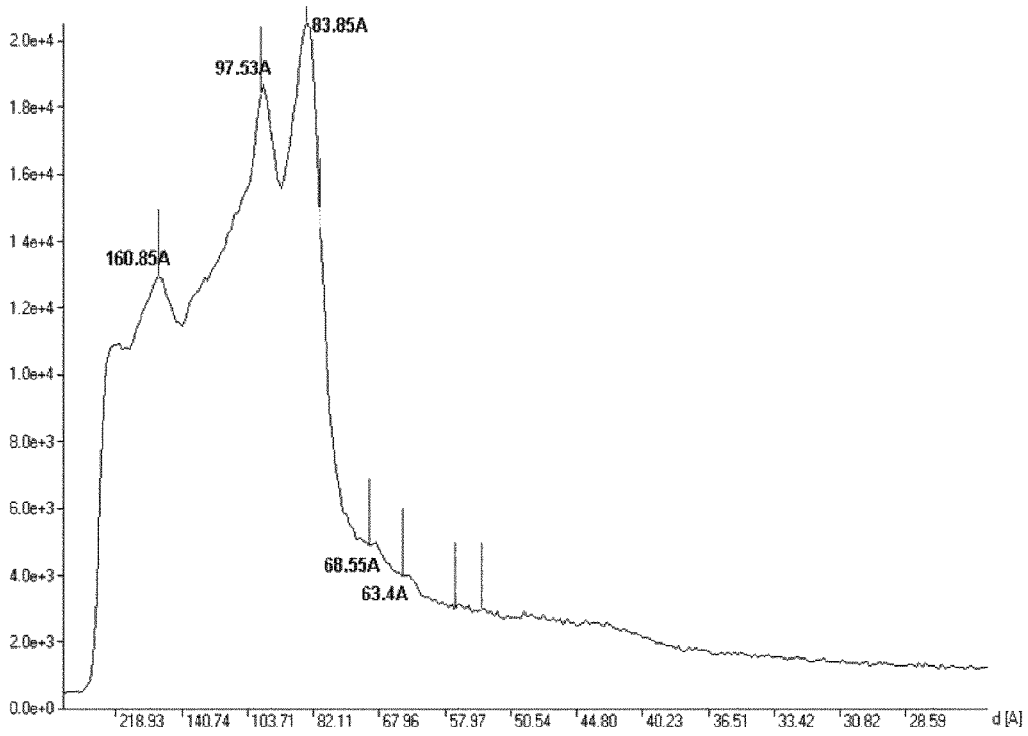

FIG. 4 is a Small angle X-ray scattering (SAXS) diagram of the ringing gel of Example A showing that the gel is in the cubic phase. The center of the primary beam is #204; The channel width at 1024 is 54.0 μm; the sample to detector distance is 276 mm, the wavelength is 1.542 Å; the lattice spacing is 278.59 Å.

Figure 5:
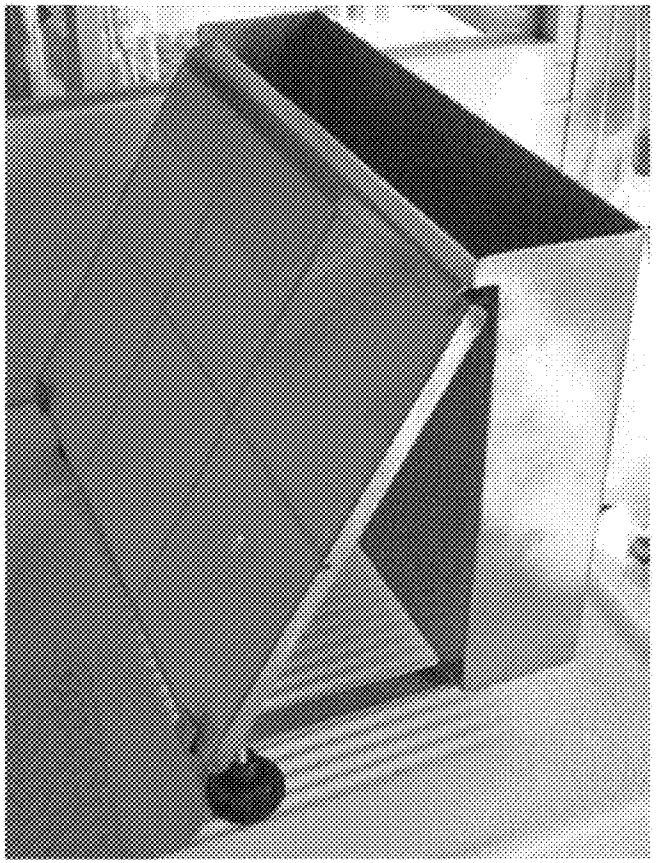

FIG. 5 is a picture of an apparatus for the determination of the solubility of the detergent which is in this case a sanitary product (Wet Slide Test).

EXAMPLES

1. Preparation and Appearances of the Precursor

Several precursors are made and comprise the ingredients as shown in Table 1. The precursors are made by first heating water to a temperature of between 70 and 80° C., then adding sodium cumene sulfonate (only for precursor I), then adding the fatty acid alkanolamide and/or the fatty acid amidoamine. In the case that the fatty acid alkanolamide and/or the fatty acid amidoamine are solid, they can be added as such or first melted. After that the anionic surfactant sodium C12-C18 sulfate or ammonium C12-C16 sulfate are added and is dissolved in the mixture. The mixture is homogenized and cooled down until room temperature.

For each precursor the set point is determined using HAAKE Rheo Stress 1 rheometer with Peltier thermostat, using the rotational mode at shear stress of 40 Pa and where the temperature range is set at −5 to +60° C., using a Cone/Plate of C35/1°. Table 1 shows the results of the set points. Table 1 also describes the appearance of the precursors at room temperature.

Figure 3:
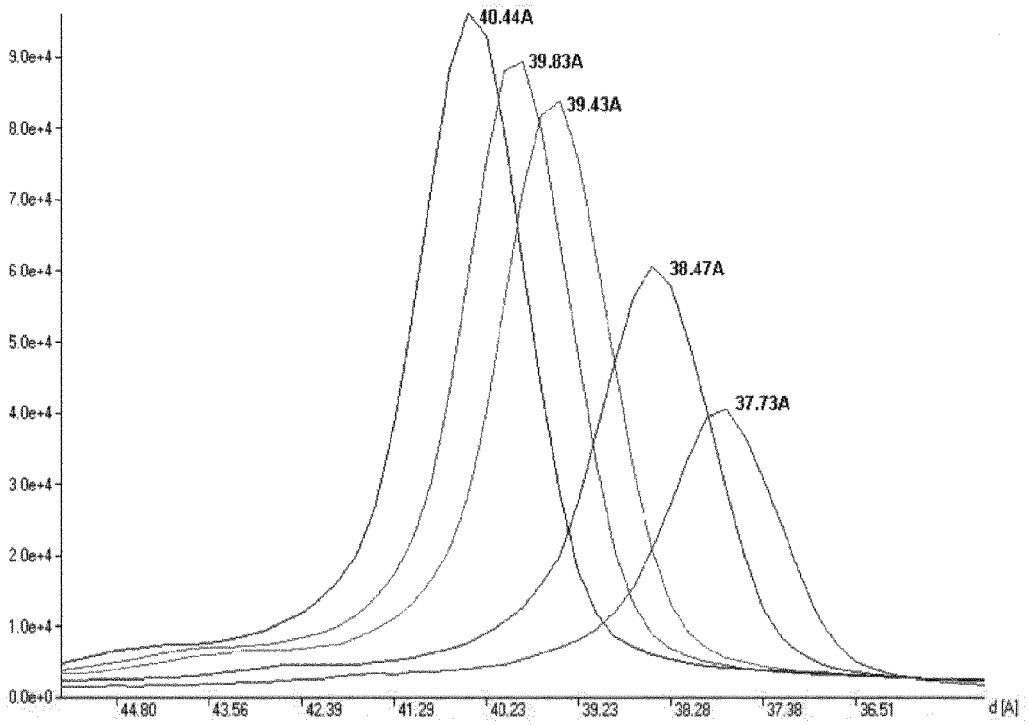
FIG. 3 is a Small angle X-ray scattering (SAXS) diagram of Precursor A (EMPICOL® iDS T10) showing that the precursor is in the lamellar phase. d[A] is the d-spacing of the scatter.

All the precursors that form a fluid paste are in the lamellar phase. FIG. 3 shows the Small angle X-ray scattering (SAXS) diagram of the Precursor, after a count time of 600 seconds, at 10, 20, 30, 60 and 80 ° C. showing that the precursor is in the lamellar phase.

TABLE 1

Precursor examples showing the ingredients and characterization. The products are all from Huntsman.

| Product name | Active Ingredient | EMPICOL ® iDS T10-Precursor A (w/w %) | Precursor B (w/w %) | Precursor C (w/w %) | Precursor D (w/w %) | Precursor E (w/w %) | Precursor F (w/w %) |
|---|---|---|---|---|---|---|---|
| Water | Water | To 100 | To 100 | To 100 | To 100 | To 100 | To 100 |
| EMPICOL ® LXN 70 | Sodium C12-16 Sulfate | 50 | 60 | 40 | 50 | — | — |
| EMPICOL ® 0775/P | Sodium C12-18 Sulfate (higher C18) | — | — | — | — | 36.66 | — |
| EMPICOL ® 0045/B | Sodium C12 Sulfate | — | — | — | — | — | 37 |
| EMPICOL ® LZB 70 | Sodium C12-18 Sulfate (Lower C18) | — | — | — | — | — | — |
| EMPICOL ® AL 70 | Ammonium C12-16 Sulfate | — | — | — | — | — | — |
| EMPILAN ® CIS | Cocamide MIPA | 35 | 28 | 42 | — | 35 | 35 |
| EMPIGEN ® S 18 | Stearamidopropyl dimethylamine | — | — | — | 35 | — | — |
| EMPIGEN ® AS/F90 | Cocamidopropyl Dimethylamine | — | — | — | — | — | — |
| ELTESOL ® SC 40 | Sodium Cumene Sulfonate | — | — | — | — | — | — |
| Precursor characterisation | | | | | | | |
| Appearance at RT (25° C.) | | Fluid Paste | Fluid Paste | Fluid Paste | White Hard Paste | White Hard Paste * | Fluid Paste |
| Set Point at 40Pa (Rheometer) | | ca. +10° C. | ca. +15° C. | ca. +13° C. | ca. +57° C. | ca. +20° C. | ca. +14° C. |

| Product name | Active Ingredient | EMPICOL ® iDS T20-Precursor G (w/w %) | EMPICOL ® iDS T30-Precursor H (w/w %) | EMPICOL ® iDS T40-Precursor I (w/w %) | EMPICOL ® iDS T50-Precursor L (w/w %) |
|---|---|---|---|---|---|
| Water | Water | To 100 | To 100 | — | To 100 |
| EMPICOL ® LXN 70 | Sodium C12-16 Sulfate | — | — | 50 | 50 |
| EMPICOL ® 0775/P | Sodium C12-18 Sulfate (higher C18) | — | — | — | — |
| EMPICOL ® 0045/B | Sodium C12 Sulfate | — | — | — | — |
| EMPICOL ® LZB 70 | Sodium C12-18 Sulfate (Lower C18) | 50 | — | — | — |
| EMPICOL ® AL 70 | Ammonium C12-16 Sulfate | — | 50 | — | — |
| EMPILAN ® CIS | Cocamide MIPA | 35 | 35 | 35 | — |
| EMPIGEN ® S 18 | Stearamidopropyl dimethylamine | — | — | — | — |
| EMPIGEN ® AS/F90 | Cocamidopropyl Dimethylamine | — | — | — | 39 |
| ELTESOL ® SC 40 | Sodium Cumene Sulfonate | — | — | 15 | — |
| Precursor characterisation | | | | | |
| Appearance at RT (25° C.) | | Fluid Paste | Fluid Paste | Fluid Paste | Fluid Paste |
| Set Point at 40Pa (Rheometer) | | ca. +13° C. | +3/15° C. | ca. 20° C. | ca 6° C. |

*Precursor E is a fluid paste at 30° C. EMPICOL ® LXN 70, LZB 70 are sodium alkyl sulfate at 70%. EMPICOL ® AL 70 is an ammonium alkyl sulfate at ca 70%. EMPICOL ® 0775/P is a sodium alkyl sulfate at ca 95%. EMPICOL ® 0045/B is sodium C12 Sulfate at ca 94%. EMPILAN ® CIS is Cocamide MIPA at ca 95%. EMPIGEN ® S 18 is a stearamidopropyl dimethylamine at ca 100%. EMPIGEN ® AS/F90 is Cocamidopropyl dimethylamine at ca 90%. ELTESOL ® SC 40 is a sodium cumene sulfonate at ca 40%.

2. Preparation of Ringing Gels

Several detergents are made from the precursors and comprise the formulations as described in Table 2. The detergents are made by heating water to a temperature of 70-80° C. To the water is sodium cumene sulfonate (SCS) added, except for example I, because there the SCS is already in the precursor (see precursor I table 1), and except for Q where no SCS is added. Then the precursor from table 1 is added to the water. The letters from the precursor in Table 1 correspond with the detergents (sanitary products) in Table 2 (note that the precursor for M, N, O, P and Q are not mentioned in Table 1). By adding the precursor, a viscous mixture is obtained. To this mixture, perfume is added. Also quantum satis (q.s.) of the preservative or dye can be added. Then the non-polar compound is added to viscous mixture and cooled down to room temperature. A ringing gel is obtained, can stick to a sanitary object.

Figure 1:
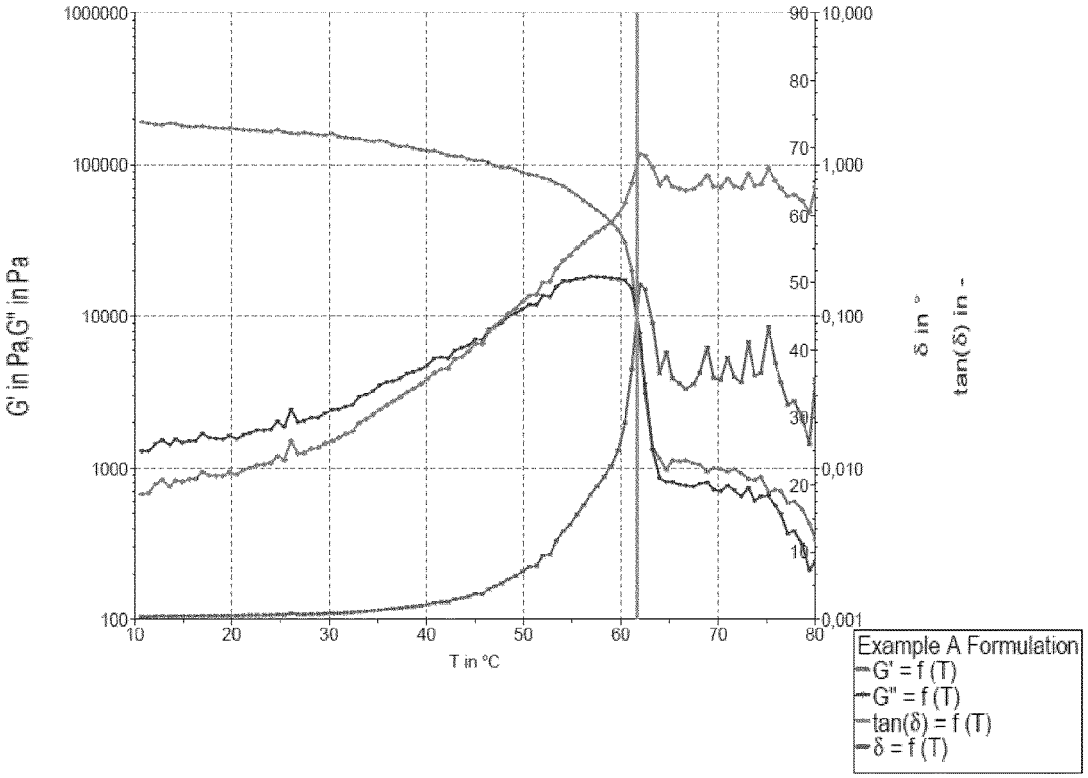
FIG. 1 is a diagram showing the results of a rheological oscillation method using a temperature ramp for gel point determination of a detergent (example A).
Figure 2:
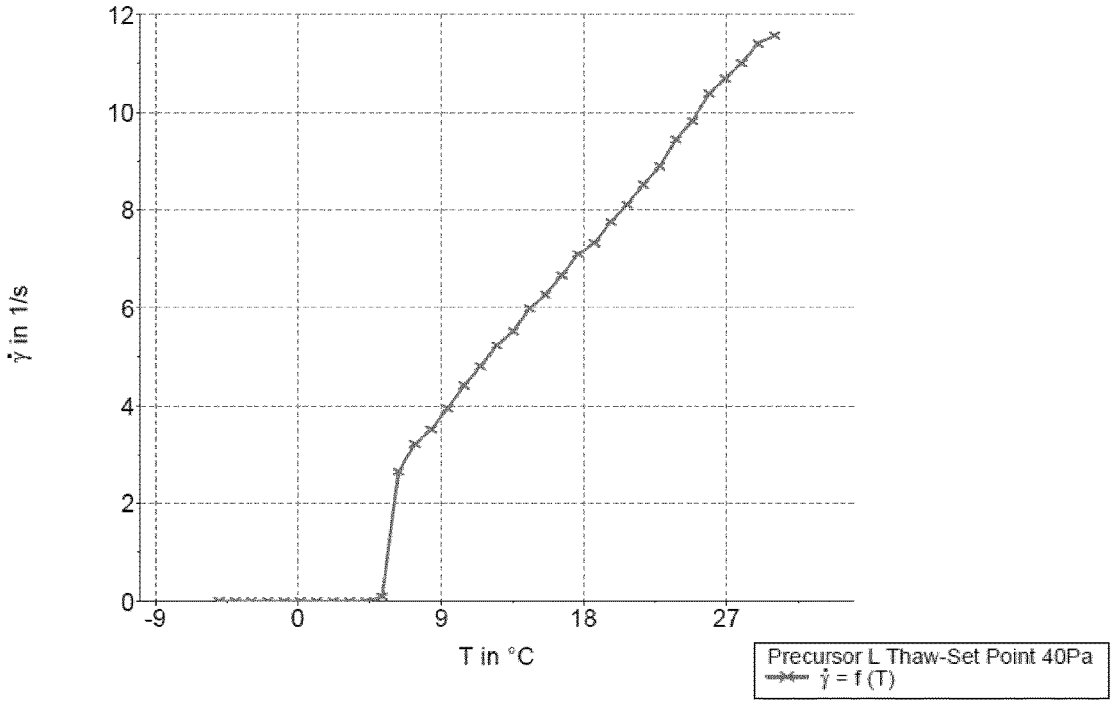
FIG. 2 is a diagram showing the results of a rheological shear rate versus temperature ramp for a gel thaw point determination of a precursor (Precursor A—EMPICOL® iDS T10).

Of all the examples the gel point has been determined using the HAAKE Rheo Stress 1 rheometer with Peltier thermostat using the Oscillation Temperature Ramp at a frequency of 1 Hz, and a temperature ramp of 10-80° C. using a strain of 0.5% using a cone/plate system having an incline of 1° and a diameter of 35 mm. FIG. 1 shows the diagram of rheological measurements of Example A.

Table 3 shows formulations using the ingredients of a detergent (sanitary product) at different concentrations. Only when a ringing gel is formed, a sanitary product is obtained that is able to stick to a sanitary object. Examples 1, 2, 8, 4, 9, 13, 16, 18 and 19 are comparative examples. Examples A, 3, 10, 11, 12, 14, 15 and 17 are examples according to the invention.

TABLE 2

Ringing gels with different formulations

| Ingredients | Example A wt % | Example B wt % | Example C wt % | Example D wt % | Example E wt % | Example F wt % | Example G wt % | Example H wt % |
|---|---|---|---|---|---|---|---|---|
| Water | To 100 | To 100 | To 100 | To 100 | To 100 | To 100 | To 100 | To 100 |
| Sodium lauryl sulfate | 14.04 | 15.63 | 12.9 | 14.19 | 14.64 | 13.33 | 14.58 | 13.27 |
| TEA Lauryl Sulfate | — | — | — | — | — | — | — | — |
| Cocamide MIPA | 13.34 | 14.85 | 12.25 | 13.48 | 13.9 | 12.66 | 13.85 | 12.6 |
| Sodium Cumene Sulfonate | 4.07 | 6.6 | 8.45 | 7.97 | 8.42 | 2.21 | 9.15 | 10.64 |
| Polyhydroxystearic acid | — | — | — | — | — | — | 0.88 | — |
| Stearamidopropyl Dimethylamine | — | — | — | — | — | — | — | 0.87 |
| Cocamidopropyl dimethylamine | — | — | — | — | — | — | — | — |
| White mineral oil[a] | 13.96 | 12.23 | — | — | 10.88 | — | 7.91 | 7.79 |
| 2-ethylhexyl carbonate | — | — | — | — | — | 15.11 | — | — |
| Polydecene hydrogenated | — | — | — | 9.51 | — | — | — | — |
| Isoparaffin | — | — | 10.5 | — | — | — | — | — |
| Perfume | 4.62 | 4.21 | 4.44 | 4.7 | 4.66 | 4.84 | 3.94 | 3.63 |
| Urea | — | — | — | — | — | — | — | — |
| Preservative/dye | q.s. | q.s. | q.s. | q.s. | q.s. | q.s. | q.s. | q.s. |
| Appearance at 25° C. | Ringing Gel | Ringing Gel | Ringing Gel | Ringing Gel | Ringing Gel | Ringing Gel | Ringing Gel | Ringing Gel |
| Gel Point (° C.) | ca 62 | ca 55 | ca 54 | ca 56 | ca 51 | ca 50 | ca 41 | ca 43 |

| Ingredients | Example I wt % | Example L wt % | Example M wt % | Example N wt % | Example O wt % | Example P wt % | Example Q wt % |
|---|---|---|---|---|---|---|---|
| Water | To 100 | To 100 | To 100 | To 100 | To 100 | To 100 | To 100 |
| Sodium lauryl sulfate | 14.13 | 14.38 | 14.48 | 14.53 | 14.03 | 14.03 | — |
| TEA Lauryl Sulfate | — | — | — | — | — | — | 13.25 |
| Cocamide MIPA | 13.42 | 13.66 | 13.75 | 13.8 | — | — | 13.96 |
| Sodium Cumene Sulfonate | 10.2 | 8.95 | 9.52 | 3.18 | 4.07 | 4.07 | — |
| Polyhydroxystearic acid | — | — | — | — | — | — | — |
| Stearamidopropyl Dimethylamine | — | — | — | — | — | 14.04 | — |
| Cocamidopropyl dimethylamine | — | — | — | — | 14.04 | — | — |
| White mineral oil[a] | 9.95 | 9.4 | 9.83 | 14.52 | 13.96 | 13.96 | 12.4 |
| 2-ethylhexyl carbonate | — | — | — | — | — | — | — |
| Polydecene hydrogenated | — | — | — | — | — | — | — |
| Isoparaffin | — | — | — | — | — | — | — |
| Perfume | 4.9 | 4.5 | 4.71 | 5.07 | 4.62 | 4.62 | 5 |
| Urea | — | — | — | — | — | — | 1 |
| Preservative/dye | q.s. | q.s. | q.s. | q.s. | q.s. | q.s. | q.s. |
| Appearance at 25° C. | Ringing Gel | Ringing Gel | Ringing Gel | Ringing Gel | Ringing Gel | Ringing Gel | Ringing Gel |
| Gel Point (° C.) | ca 47 | ca 45 | ca 53 | ca 65 | ca 47 | ca 55 | ca 50° C. |

[a]Several grades with different physical properties

TABLE 3

Formulations for making detergents (sanitary products) having different concentrations.

| Ingredients | 1 | Example A | 2 | 8 | 3 | 4 | 9 | 10 | 11 | 12 | 13 |
|---|---|---|---|---|---|---|---|---|---|---|---|
| Water | To 100 | To 100 | To 100 | To 100 | To 100 | To 100 | To 100 | To 100 | To 100 | To 100 | To 100 |
| Sodium lauryl sulfate | 14 | 14 | 14 | 5 | 8 | 20 | 14 | 14 | 14 | 14 | 14 |
| Cocamide MIPA | 8 | 13.3 | 20 | 14 | 14 | 14 | 14 | 14 | 14 | 14 | 14 |
| Sodium Cumene Sulfonate | 4.07 | 4.07 | 4.07 | 4.07 | 4.07 | 4.07 | 4.07 | 4.07 | 4.07 | 4.07 | 4.07 |
| White mineral oil[a] | 13.96 | 13.96 | 13.96 | 13.96 | 13.96 | 13.96 | 5 | 20 | 22 | 24 | 25.9 |
| Perfume | 4.62 | 4.62 | 4.62 | 4.62 | 4.62 | 4.62 | 4.62 | 4.62 | 4.62 | 4.62 | 4.62 |
| Appearance at 25° C. | Separated: Two Layers | Ringing Gel | Gel Not Ringing | Clear Liquid | Ringing Gel | Hard Paste Not Processable | Hazy Gel Not Ringing | Ringing Gel | Ringing Gel | Ringing Gel | Not Processable |
| Gel Point (° C.) | — | ca 62 | — | — | Ca 42° C. | — | — | ca 58° C. | ca 60° C. | ca 71° C. | — |

| Ingredients | 16 | 14 | 15 | 17 | 18 | 19 |
|---|---|---|---|---|---|---|
| Water | To 100 | To 100 | To 100 | To 100 | To 100 | 0 |
| Sodium lauryl sulfate | 14 | 14 | 14 | 14 | 14 | 14 |
| Cocamide MIPA | 14 | 14 | 14 | 14 | 14 | 14 |
| Sodium Cumene Sulfonate | 0 | 2 | 6 | 8 | 12 | 15.75 |
| White mineral oil[a] | 13.96 | 13.96 | 13.96 | 13.96 | 13.96 | 13.96 |
| Perfume | 4.62 | 4.62 | 4.62 | 4.62 | 4.62 | 4.62 |
| Appearance at 25° C. | Not Processable | Ringing Gel | Ringing Gel | Ringing Gel | Ringing Gel prone to separation | Separated Gel |
| Gel Point (° C.) | — | ca 61° C. | ca 60° C. | ca 53° C. | ca 30° C. | — |

[a]Several grades with different physical properties

Table 4 shows the performance of the ringing gels from example A and E and shows that 10 grams of ringing gel can have up to 90 flushes before it is completely dissolved in water.

Further the ringing gels were tested on a wet slide test apparatus, which is a testing device (see FIG. 5) used for comparing the solubility of ringing gels with different composition.

The test is carried out by applying the ringing gels (extruded in disc or sticker shape) on a tiled surface of the testing device at about 2 cm from the rim and measuring the time taken for the water (tap water at 15° C.) to consume them completely with a continuous flow (600 liter/hour).

TABLE 4

Performances of detergents (sanitary products).

| Properties | Example A | Example E |
|---|---|---|
| Appearance at 25° C. | Ringing Gel | Ringing Gel |
| Gel Point (° C.) | 62 | 51 |
| No Flushes[a] (Sticker) | 50-90 | 40-65 |
| Wet Slide Test with Stickers (min) | 11 | 9 |

[a]Numbers collected from the results obtained by a number of panelists.

3. Ratio of Alkyl Sulfate and Amide Determines the Type of Ringing Gel

The inventors found that the ratio of the alkyl sulfate and the fatty acid amidoamine or fatty acid alkanolamide in the detergents determines if a clear ringing gel is formed or a cloudy or hazy ringing gel that is not homogeneous. As is shown in Table 5, the ratio of the weight percent of the alkyl sulfate (Sodium lauryl sulphate or SLS) and the fatty acid alkanolamide (Cocamide MIPA or CMIPA) in the detergent is preferably 45:55 or 50:50. Other ratios provide ringing gels that are not clear, slightly hazy or cloudy. These ringing gels are not homogeneous and provide birefringence when analyzed under a polarized microscopy.

TABLE 5

Phase change depending on the ratio SLS and CMIPA in the formulation of the detergent.

| | SLS:CMIPA | SLS:CMIPA | SLS:CMIPA (Example A) | SLS:CMIPA |
|---|---|---|---|---|
| SAXS Identification | Cubic | Cubic | Cubic | Cubic |
| RATIO | 40:60 | 45:55 | 50:50 | 55:45 |
| Appearance @ room temperature | Slightly Hazy Ringing Gel | Clear Ringing Gel | Clear Ringing Gel | Cloudy Ringing Gel Not homogeneous |
| Gel Point (via Rheometer) | 50° C. | 56° C. | 62° C. | 77° C. |
| Polarized Microscopy | Mixed Phases | No Birefringence | No Birefringence | Mixed Phases |

4. The Water Content in the Formulation of the Detergent

Table 6 shows appearances at room temperature and phase identifications of formulations comprising Precursor A (Sodium lauryl sulfate, Cocamide MIPA and water), White Mineral Oil, Perfume and Sodium Cumene Sulfonate and different total amounts of water content.

The formulations comprise the following stock formulation, which has not intentionally added water, and additional water as shown in table 6. The stock formulation comprises:

Precursor A—EMPICOL® iDS T10 (Sodium Lauryl Sulfate, Cocamide MIPA and water): 40.2 g;

Non-polar Phase (White Mineral Oil, Perfume): 18.58 g; and

ELTESOL® SC 40 (Sodium Cumene Sulfonate 40% in water): 10.17 g

In case that Cocamide MIPA and SLS are used as fatty acid alkanolamide and alkyl sulfate, the water content can vary between 40.6 and 60.2 wt % so that a ringing gel in cubic phase can be formed. A person skilled in the art will realize that a variation in water content can occur depending on the type of alkyl sulfate and/or fatty acid alkanolamide and/or fatty acid amidoamine that is used.

TABLE 6

Phase change depending on the water content in the detergent.

| Water Added to the Stock Formulation (g) | Total Water Content (%) | Appearance at room temperature | Phase Identification |
|---|---|---|---|
| — | 30 (Precursor A) | Fluid Paste | Lamellar (Lα) |
| — | 18.2 (Stock Formulation) | Fluid Paste | Lamellar (Lα) |
| 5 | 24.9 | Hard Paste | Lamellar to Hexagonal |
| 10 | 30.8 | Hard Paste | Lamellar to Hexagonal |
| 15 | 36 | Hard Paste | Lamellar to Hexagonal |
| 20 | 40.6 | Gel | Hexagonal |
| 25 | 44.8 | Ringing Gel | Cubic |
| 31 | 49.3 (Example A) | Ringing Gel | Cubic |
| 35 | 51.8 | Ringing Gel | Cubic |
| 40 | 54.9 | Ringing Gel | Cubic |
| 45 | 57.8 | Ringing Gel | Cubic |
| 50 | 60.2 | Gel | Cubic to Liquid |
| 60 | 64.7 | Two phases liquid | Liquid |

The invention claimed is:

1. A precursor for making a detergent wherein the precursor comprises:

water having a concentration of between 16 wt % and 44 wt % based on the total weight of the precursor;

an alkyl sulfate having a concentration of between 25 wt % and 45 wt % based on the total weight of the precursor; and a fatty acid alkanolamide and/or a fatty acid amidoamine having a concentration of between 25 wt % and 45 wt % based on the total weight of the precursor;

wherein the precursor is in a lamellar phase, and is able to form a ringing gel after addition of extra water and one or more non-polar compounds;

wherein the fatty acid alkanolamide corresponds to the formula

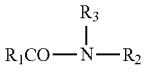

(I)

wherein R1 is an alkyl, alkenyl, hydroxyalkyl or hydroxyalkenyl having 6 to 22 carbon atoms, R2 is a hydroxyalkylgroup containing 2 to 6 carbon atoms, and R3 is hydrogen or an alkyl group or has the same meaning as R2; and wherein the fatty acid amidoamine corresponds to the formula

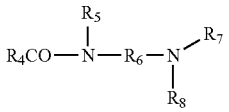

(II)

wherein:

R4 is alkyl, alkenyl, hydroxyalkyl or hydroxyalkenyl containing 6 to 22 carbon atoms;

R5 is hydrogen, an alkyl group, or a hydroxyalkylgroup containing 2 to 4 carbon atoms;

R6 is an alkyl group containing 2 to 4 carbon atoms; and

R7 and R8 are each independently hydrogen, an alkyl group, or a hydroxyalkyl group containing 2 to 4 carbon atoms.

2. The precursor according to claim 1, wherein the precursor is able to form a ringing gel after addition of extra water and one or more non-polar compounds that is able to adhere to a sanitary object.

3. The precursor according to claim 1, wherein the precursor has a set point that is lower than 25° C. and which precursor is pourable at temperatures of between 5 to 10° C. more than the set point.

4. The precursor according to claim 1, wherein the relative ratio of the amount of alkyl sulfate and the fatty acid amidoamine and/or the fatty acid alkanolamide is between 40/60 and 60/40.

5. The precursor according to claim 1, wherein the fatty acid alkanolamide is selected from the group consisting of cocamide MIPA, cocamide MEA, cocamide DEA, Cocamide methyl MEA, Lauramide MEA, Lauramide DEA, Lauramide MIPA, Myristamide MEA, Myristamide DEA, Myristamide MIPA, Stearamide MEA, Stearamide DEA, Stearamide MIPA, Hydroxystearamide MEA, Isostearamide DEA, N-Tris(hydroxymethyl) methyl lauramide, Oleamide MEA, Oleamide DEA, Oleamide MIPA, Soyamide MEA, Soyamide DEA, Soyamide MIPA, Behenamide MEA, Behenamide DEA, Palmitamide MEA, Palmitamide DEA, Ricinoleamide MEA , Ricinoleamide DEA, Ricinoleamide MIPA, Tallowamide MEA, Tallowamide DEA, Undecylenamide MEA, Undecylenamide DEA, N-Lauroyl-N-methylglucamide, N-Cocoyl-N-methylglucamide or a mixture thereof.

6. The precursor according to claim 1, wherein the fatty acid amidoamine is Stearamidopropyl Dimethylamine, Cocamidopropyl dimethylamine, Lauryl Myristyl amidopropyl dimethylamine , Stearamidoethyl diethylamine, Isostearamidopropyl dimethylamine, Lauramidopropyl dimethylamine, Myristamidopropyl dimethylamine, Soyamidopropyl dimethylamine, Oleamidopropyl dimethylamine, Palmitamidopropyl dimethylamine, Ricinoleamidopropyl dimethylamine, Tallowamidopropyl dimethylamine, Behenamidopropyl dimethylamine or a mixture thereof.

7. The precursor according to claim 1, wherein the alkyl sulfate comprises an alkyl group containing 6 to 22 carbon atoms and/or where the alkyl sulfate is a metallic alkyl sulfate, ammonium or an amine derivative of an alkyl sulfate.

8. A detergent for cleaning and/or disinfecting and/or deodorizing comprising:

the precursor according to claim 1, extra water so that the concentration of the total amount of water in the detergent is between 35 and 70 wt % based on the total weight of the detergent, and one or more non-polar compounds and/or a perfume, wherein the product is a hard ringing gel that has a gel point that is higher than 40° C.

9. The detergent according to claim 8 that is able to adhere to a sanitary object after application.

10. The detergent according to claim 8, wherein the total water content is between 40 and 65 wt % based on the total weight of the detergent.

11. The detergent according to claim 8, wherein the fatty acid alkanolamide and/or the fatty acid amidoamine has a content of between 8 and 20 wt % based on the total weight of the detergent.

12. The detergent according to claim 8, wherein the content of the alkyl sulfate is between 5 and 20 wt % based on the total weight of the detergent.

13. The detergent according to claim 8, wherein the content of the one or more non-polar compounds is between 3 and 30 wt % based on the total weight of the detergent.

14. The detergent according to claim 8, further comprising a hydrotrope, wherein the hydrotrope has a content from 0 to 16wt % based on the total weight of the detergent.

15. The detergent according to claim 8, wherein the relative ratio of the amount of alkyl sulfate and the fatty acid amidoamine and/or the fatty acid alkanolamide is between 40/60 and 60/40.

16. The detergent according to claim 8, wherein the one or more non-polar compounds are selected from the group consisting of hydrocarbon oils, alkylcarbonates, synthetic and vegetable oils, essential oils, oily esters, silicon oils, perfumes or combination thereof.

17. The detergent according to claim 8, further comprising a pH modifier, a pH buffer, a structuring agent, a solubility controller, a preservative, a complexing agent, a biocide, a lime scale remover, a bleaching agent, enzymes, a polymer and/or a dye.

18. A method for producing a detergent comprising:

heating water to a temperature of 70-80° C;

optionally adding a hydrotrope;

adding a precursor according to claim 1 to obtain a viscous liquid mixture;

optionally adding a perfume;

optionally adding a gel point modifier, a solubility controller, a pH modifier, a pH buffer, a structuring agent, a preservative, a complexing agent, a biocide, a lime scale remover, a bleaching agent, enzymes, a polymer and/or a dye;

adding one or more non-polar compounds; and cooling the obtained mixture to room temperature to obtain a hard ringing gel detergent.

19. The detergent according to claim 8, further comprising a hydrotrope.

20. The detergent according to claim 8, wherein the alkyl sulfate has a content of between 12 and 16 wt % in the detergent.

21. The detergent according to claim 8, wherein the fatty acid alkanolamide and/or the fatty acid amidoamine have a content of between 12 and 16 wt % based on the weight of the detergent.

22. The detergent according to claim 8, wherein the one or more non-polar compounds has a content of between 7 and 25 wt % in the detergent.

23. A precursor for making a detergent wherein the precursor comprises:

water having a concentration of between 16 wt % and 44 wt % based on the total weight of the precursor;

an alkyl sulfate having a concentration of between 25 wt % and 45 wt % based on the total weight of the precursor; and a fatty acid amidoamine;

wherein the precursor is in a lamellar phase, and is able to form a ringing gel after addition of extra water and one or more non-polar compounds;

wherein the fatty acid amidoamine corresponds to the formula (II)

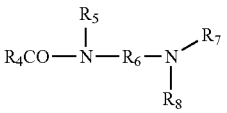

wherein R4 is alkyl, alkenyl, hydroxyalkyl or hydroxyalkenyl containing 6 to 22 carbon atoms;

R5 is hydrogen, an alkyl group, or a hydroxyalkyl group containing 2 to 4 carbon atoms;

R6 is an alkyl group contaning 2 to 4 carbon atoms; and

R7 and R8 are each independently hydrogen, an alkyl group or, a hydroxyalkyl group containing 2 to 4carbon atoms.

24. A detergent for cleaning and/or disinfecting and/or deodorizing comprising:

the precursor according to claim 23;

extra water so that the concentration of the total amount of water in the detergent is between 35and 70 wt % based on the total weight of the detergent; and one or more non-polar compounds and/or a perfume;

wherein the product is a hard ringing gel that has a gel point that is higher than 40 ° C.

* * * * *